US011143469B2

(12) United States Patent
Lucanský

(10) Patent No.: US 11,143,469 B2
(45) Date of Patent: Oct. 12, 2021

(54) PISTOL WITH A LOW-LYING BARREL

(71) Applicants: M41B A.S., Prague (CZ); SCOOBY, A.S., Radotín (CZ)

(72) Inventor: Ján Lucanský, Trencín (SK)

(73) Assignees: M41B A.S., Prague (CZ); SCOOBY, A.S., Prague (CZ)

( * ) Notice: Subject to any disclaimer, the term of this patent is extended or adjusted under 35 U.S.C. 154(b) by 36 days.

(21) Appl. No.: 16/309,824

(22) PCT Filed: Jun. 14, 2017

(86) PCT No.: PCT/SK2017/050002
§ 371 (c)(1),
(2) Date: Dec. 13, 2018

(87) PCT Pub. No.: WO2017/217939
PCT Pub. Date: Dec. 21, 2017

(65) Prior Publication Data

US 2019/0310036 A1 Oct. 10, 2019

(30) Foreign Application Priority Data

Jun. 15, 2016 (SK) ..... PP50037-2016

(51) Int. Cl.
*F41A 3/02* (2006.01)
*F41A 3/56* (2006.01)
(Continued)

(52) U.S. Cl.
CPC ..... *F41A 3/02* (2013.01); *F41A 3/12* (2013.01); *F41A 3/54* (2013.01); *F41A 3/56* (2013.01);
(Continued)

(58) Field of Classification Search
CPC ..... F41A 3/02; F41A 3/56; F41A 3/62; F41A 5/02; F41A 3/12; F41A 3/54; F41A 5/00
(Continued)

(56) References Cited

U.S. PATENT DOCUMENTS 992,854 A * 5/1911 Cobb ..... F41A 3/54 89/147
1,431,979 A * 10/1922 Pomeroy ..... F41A 3/44 89/170
(Continued)

FOREIGN PATENT DOCUMENTS

AT 396 035 B 5/1993
DE 10 2012 109 687 B3 2/2014
(Continued)

OTHER PUBLICATIONS

International Search Report, issued in PCT/SK2017/050002, dated Oct. 6, 2017.
(Continued)

*Primary Examiner* — Joshua E Freeman
(74) *Attorney, Agent, or Firm* — Birch, Stewart, Kolasch & Birch, LLP

(57) ABSTRACT

In the fixed frame it has a base, in which a barrel with the axis below the level of the upper edge of the shooter's hand, a trigger, a buffer and a long ejector are attached. A pistol grip with a cartridge magazine is obliquely slid into the frame and attached. A semi-embedded moving slide, containing especially a closed launch pad, a firing pin, an obliquely placed extractor and a rob of the trigger mechanism, is inserted into the frame from above. The slide is covered from above by upper body attached to the barrel and at two points to the frame, which carries sights at the top and has elements of the hammer system placed on the lower side.

7 Claims, 9 Drawing Sheets

Figure 1:
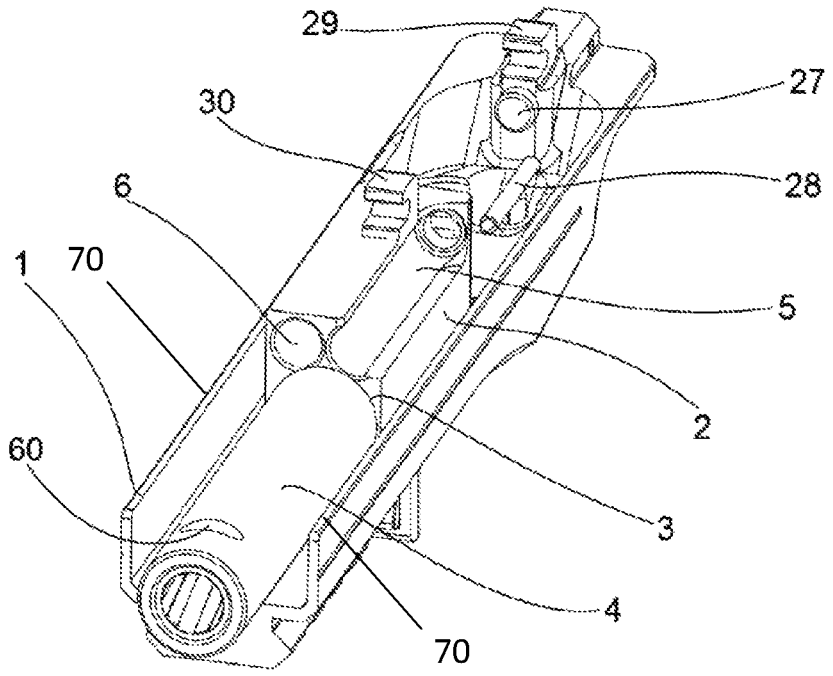

(51) Int. Cl.

| | |
|---|---|
| ***F41A 3/62*** | (2006.01) |
| ***F41A 5/02*** | (2006.01) |
| ***F41A 5/00*** | (2006.01) |
| ***F41A 3/54*** | (2006.01) |
| ***F41A 3/12*** | (2006.01) |

(52) U.S. Cl.
CPC ..... *F41A 3/62* (2013.01); *F41A 5/00* (2013.01); *F41A 5/02* (2013.01)

(58) Field of Classification Search
USPC ..... 89/24
See application file for complete search history.

(56) References Cited

U.S. PATENT DOCUMENTS

| | | | | | |
|---|---|---|---|---|---|
| 2,468,784 | A * | 5/1949 | Seagraves | F41A 3/26 | 89/185 |
| 2,899,767 | A * | 8/1959 | Boudreau | F41C 27/22 | 42/75.01 |
| 4,974,356 | A * | 12/1990 | Kelsey, Jr. | F41A 17/36 | 42/69.03 |
| 4,977,815 | A * | 12/1990 | Stephens | F41A 3/62 | 42/16 |
| 6,530,306 | B1 * | 3/2003 | LaFleur | F41A 3/46 | 42/70.08 |
| 8,037,805 | B1 * | 10/2011 | Neroni | F41A 3/28 | 89/196 |
| 8,495,831 | B1 * | 7/2013 | Kohout | F41C 3/00 | 42/42.03 |
| 8,539,706 | B1 * | 9/2013 | Vieweg | F41A 3/82 | 42/1.06 |
| 2009/0277067 | A1 * | 11/2009 | Gregg | F41A 3/66 | 42/69.01 |
| 2010/0242329 | A1 * | 9/2010 | Carr | F41A 11/04 | 42/14 |
| 2012/0317854 | A1 * | 12/2012 | Nierenberg | F41C 23/12 | 42/1.06 |
| 2014/0075799 | A1 * | 3/2014 | Hangen | F41A 3/86 | 42/1.06 |
| 2015/0241155 | A1 * | 8/2015 | Heizer | F41A 19/22 | 42/69.03 |
| 2015/0330736 | A1 * | 11/2015 | Love | F41C 3/00 | 42/16 |
| 2016/0010933 | A1 * | 1/2016 | Bonner | F41A 19/10 | 42/69.01 |

FOREIGN PATENT DOCUMENTS

| | | | |
|---|---|---|---|
| EP | 1 205 726 | A2 | 5/2002 |
| FR | 2 483 595 | A1 | 12/1981 |
| GB | 191210566 | A | 8/1912 |
| RU | 2 223 458 | C1 | 2/2004 |
| WO | WO 96/17217 | A2 | 6/1996 |
| WO | WO 2014/123628 | A2 | 8/2014 |
| WO | WO 2016/060774 | A2 | 4/2016 |

OTHER PUBLICATIONS

Written Opinion of the International Searching Authority, issued in PCT/SK2017/050002, dated Oct. 6, 2017.

* cited by examiner

PISTOL WITH A LOW-LYING BARREL

TECHNICAL FIELD

Present invention relates to a pistol with a low-lying barrel. The invention relates to the field of small arms, in particular pistols.

PRIOR ART

The development of pistols as small arms has a long history. Many different types have been created, which have undergone many improvements.

All known pistols are characterized by common parts, which include the frame, barrel, sights, slide, trigger group with safeties, firing pin and pistol grip with the cartridge magazine. The upper part of a pistol normally consists of a movable slide guided in the frame and equipped with sights, in the front with the front sights and in the back with the rear sights.

A drawback of such a design is the necessity of a precise placement of the slide affecting the accuracy of the weapon. In terms of shooting accuracy, it is neither logical nor desirable to mount sights or collimator sights on moving parts of the weapon.

The use of aiming optoelectronics requires various additional side mounts protruding from the outline of the weapon. These adversely affect its overall dimensions.

Currently marketed collimator sights, attached on a movable slide, are exposed to shock acceleration of several G, which leads to their fast deterioration. This attachment possibility is not always acceptable, especially in the case of dimensionally larger collimator sights, which would considerably increase the weight of the recoil mass or would not be able to withstand such a strong overload caused by the slide movement. This also applies to micro-thermovision collimator sights.

A moving slide in the upper part of the pistol and the barrel at its level place the center of gravity of these elements high above the shooter's hand and adversely affect the stroke of the weapon during a shot and the impact of the slide mass in the rear end position. A precise guideway of the slide with small clearances within the placement and a precise setting of the ejector are necessary for a proper functioning of the cartridge case ejection after a shot.

The pistol firing ping is normally relatively massive. If the weapon falls on the barrel muzzle, the inertia of its mass may trigger a spontaneous shot. To prevent such a situation, pistols are equipped with a firing pin block.

Gases from the burnt cartridge powder charge are used to decelerate the slide during its backward movement. These are conducted from the barrel into the gas piston cavity, in which they decelerate the moving piston. This deceleration system is placed under the barrel on well-known pistols. During a long-lasting shooting, hot gasses overheat the frame above the trigger, which annoys the shooter.

A well-known solution of this issue is the installation of an additional plastic insert functioning as a thermal shield.

The pistol grip forms the lower part of the pistol and is connected to the frame. The usual connection of the frame with the pistol grip in a plane parallel to the barrel axis is inconvenient due to the subjection of the joint to shear stress. There are known cases of the cracking of the pistol grip, frame and/or connecting elements.

One pistol according to the known state of the art is described in WO 2016/060774 A2. Further, a pistol known from WO 2014/123628 A2 has a low-lying barrel (14), whereby its load-carrying element is a fixed frame (28) opened from above. This document is considered as the closest prior art. However, the pistol described herein has different geometry and arrangement of internal elements.

With respect to the mentioned state of the art, the pistol according to this invention, by means of the features defined in the claims, further improves the accuracy of a pistol by lowering the centerline of the barrel and provides improved aiming by having a fixed frame with aiming means on them.

Substance of Invention

The above-mentioned drawbacks are eliminated by the present invention, whose essence consists in the fact that the load-carrying element of the pistol is a fixed frame opened from above, which is concave in the rear part and partially passable along the whole height. A base projecting over the upper edges of the frame and finished with a mid hook is attached in the middle part of the frame. A gas piston cavity is created in the base. The rear part of a thick-walled barrel, attached in the base or also in the frame, as appropriate, is inserted in the base under the gas piston cavity.

Furthermore, the trigger, whose shoulder is movably connected with a swiveling disconnector, is movably anchored in the frame. A bottom body is attached on the lower side of the frame. The trigger with a safety of trigger is led out of the frame.

Around the magazine hole in the frame there is a touch surface inclined against longitudinal upper edges of the frame, the pistol grip with the cartridge magazine being propped, mounted and secured against the touch surface.

A buffer tube is fabricated in the rear part of the frame. An ejector oriented towards the base is attached in it. A rear hook is fabricated on top of the buffer tube. The rear hook protrudes above the upper edges of the frame.

A moving slide, open both from above and below, is inserted and half-embedded in the frame. The slide is equipped with a launch pad, an extractor, a light firing pin and a rod of the trigger mechanism. The slide includes a piston and a guide stud with a recoil spring, which are interconnected with a clip. From above, the slide is covered with fixed upper body, which have a bent front section.

An exact gap of barrel is created in it, through which the upper body are slid onto the barrel muzzle. On the lower side, in the middle section of the upper body, there is a cavity, in which a mid counterpart is attached, by means of which the upper body are connected via the mid hook and the base with the frame. A rear counterpart stuck into the rear hook in the frame is attached in the rear part of the upper body. The hammer system of the pistol, which is mounted on the inner side of the upper body, consists of a hammer catch, a spring of the hammer catch, a hammer, a hammer stud with an indicator and with a hammer spring, as well as with a roller. Front sights in the front and adjustable rear sights in the back are mounted on the outer, upper surface of the upper body. The slide guideway is delimited by the inner surfaces of the upper body and frame.

The slide has a closed launch pad, in which next to the middle firing pin hole there is also an ongoing gap for the ejector with a conical mouth from the rear side of the launch pad. An obliquely placed extractor, swiveling sideways against the pressure of the extractor spring by the inserted cartridge ends next to the launch pad. The guide stud and the piston are connected with a clip in the front part of the slide.

The movement of rod in the slide is delimited only in one line. The rod being secured against falling out.

It is a separated connecting element of the trigger via the disconnector, which are located in the frame with the hammer system through the hammer catch, which are installed in the upper body. The trigger has the shape of a wide "Y" with two upward directed shoulders, between which the safety of the trigger is movably anchored and which are bent backwards from the anchoring point. At the end, each or only one shoulder is held down by its trigger spring with the disconnector being embedded at the end of one of the shoulders.

The present invention has the following advantages: the barrel axis is below the level of the upper edge of the shooter's hand. The semi-embedding of the slide into the frame lowers the center of gravity against the ergonomic point—the hand edge. It has a positive effect on the stroke of the weapon after a shot is fired. If a gas brake of the slide is placed above the barrel, the frame does not overheat during a long-lasting shooting. An oblique attachment of the pistol grip against the barrel axis leads, in addition to the overall stiffness, especially to the joint being subjected to pressure stress, not to shear stress, which eliminates the cracking of the pistol grip, frame or connecting elements. Three mounting points of the upper body—the barrel muzzle, the mid and rear hooks—provide a firm and stiff joint guaranteeing the accuracy of the collimating elements. The accuracy of the weapon depends on the precision of the placement of the slide in the frame because the collimating elements are not placed on a moving slide but are placed on the non-moving upper body, firmly connected with the barrel and frame. The moving slide is guided through the inner surfaces of the frame and upper body. It allows its looser placement, which is thus less difficult to manufacture and less sensitive to impurities in the guideway. Optoelectronics, collimator sights and other, larger sights may be mounted on the upper body without them being exposed to overloads and without an adversary increase of the recoil weight of the slide. A precise guideway of the slide is not necessary even for the correct and repeatedly even functioning of the cartridge case ejector, which is always guided into the correct position against the launch pad via the conical entrance of the ongoing gap. The ejector, guided in the ongoing gap, is not subjected to bending stress. Thus, its shank can be extended as close to the barrel as possible. This has a positive effect on the start of the ejection of the cartridge case immediately after it leaves the barrel chamber. The energetic recoil pulse from the shot is then even more intensive and the ejection is fiercer with all types and volumes of cartridge charge.

Another advantage of the invention is the firing pin, whose weight is about 1/24 of the weight of a usual firing pin. It is held in the basic position by the force of the spring of the firing pin. Thus, if the pistol falls on the barrel muzzle, it definitely cannot come to a spontaneous initiation due to the inertial mass of the firing pin. Therefore, it is not necessary to install the generally widespread firing pin block in the system.

The trigger spring causes trigger pull. The invention allows the trigger spring to be only fitted onto one shoulder, which halves the trigger pull. This pull can also be influenced.

OVERVIEW OF FIGURES IN DRAWINGS

An illustrative explanation is provided via the attached drawings, where

Figure 2:
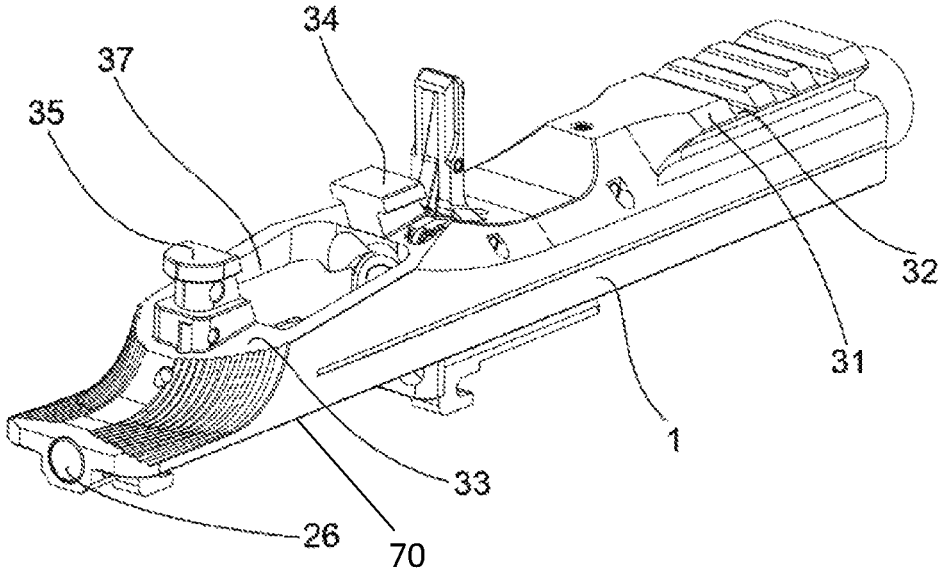
Figure 3:
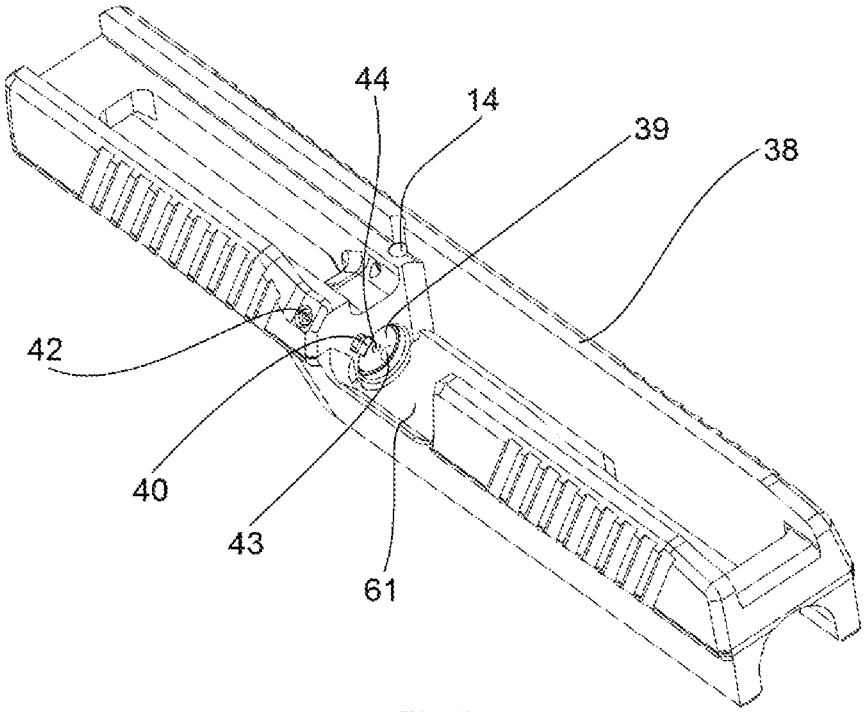
Figure 4:
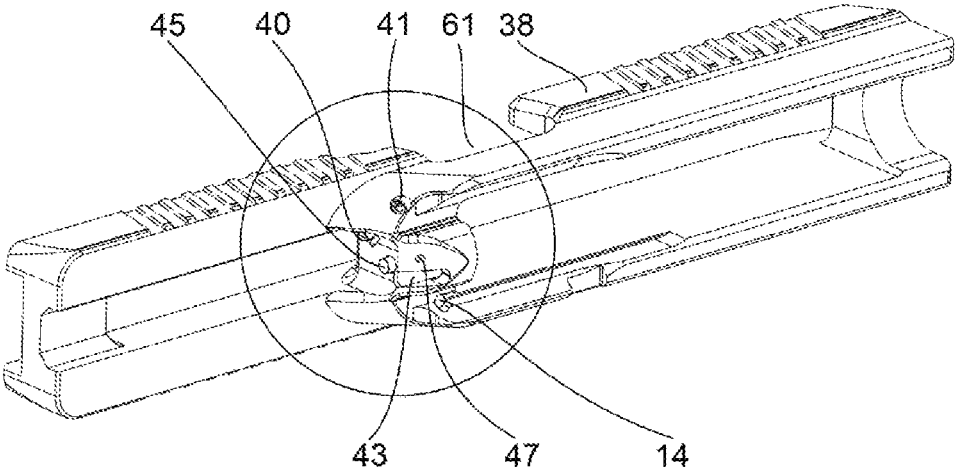
Figure 5:
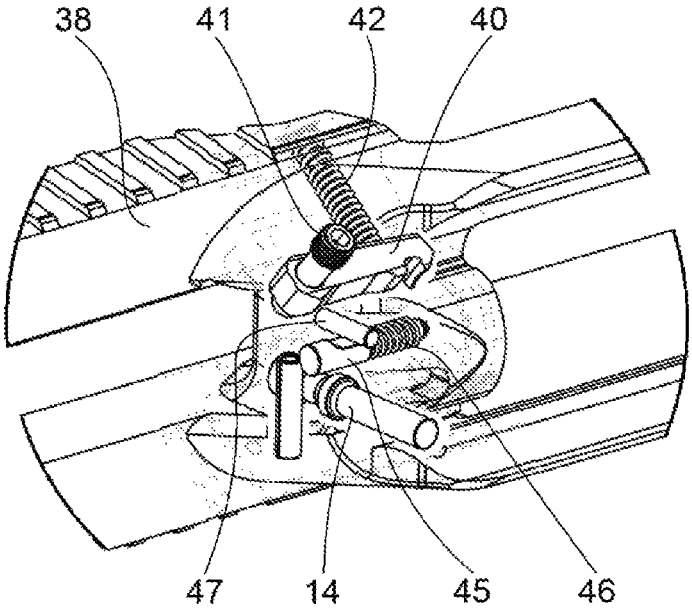
Figure 6:
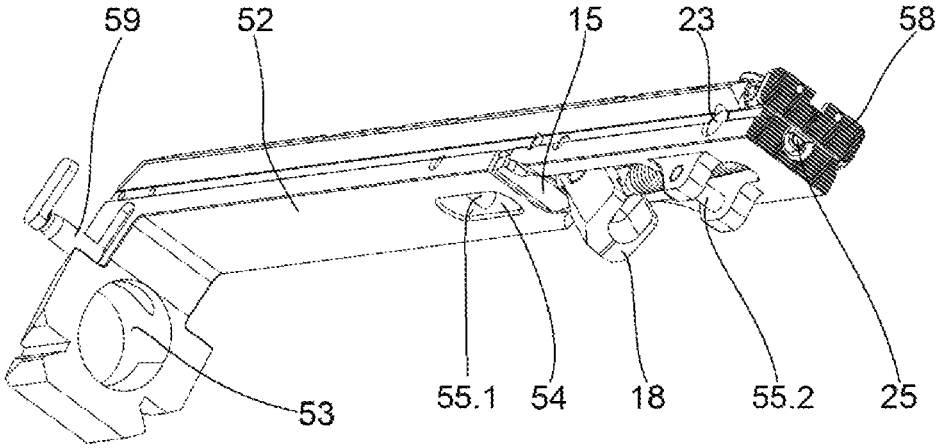
Figure 7:
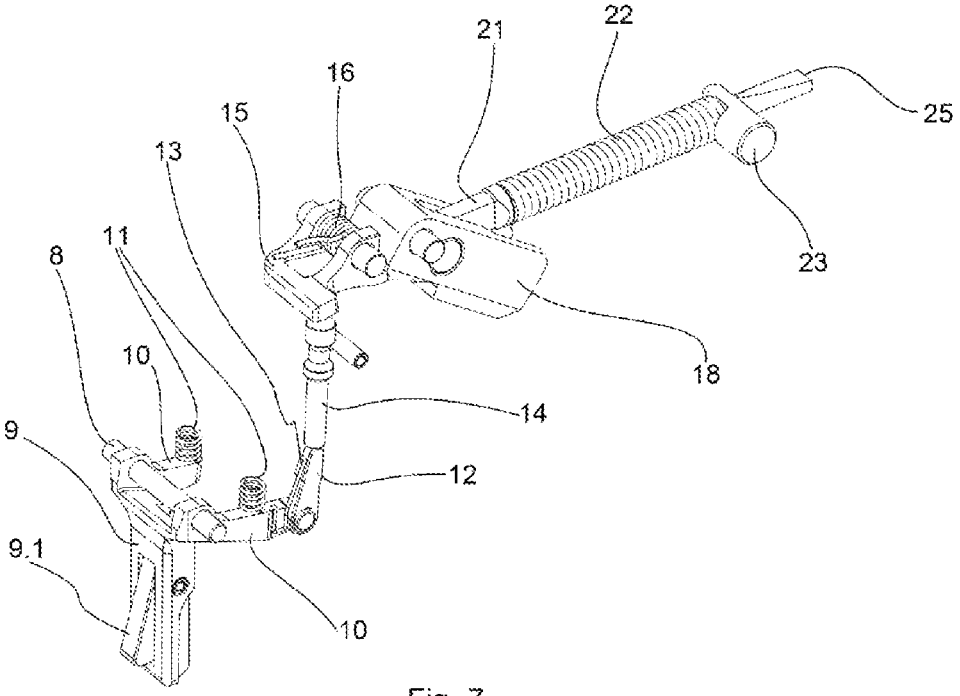
Figure 8:
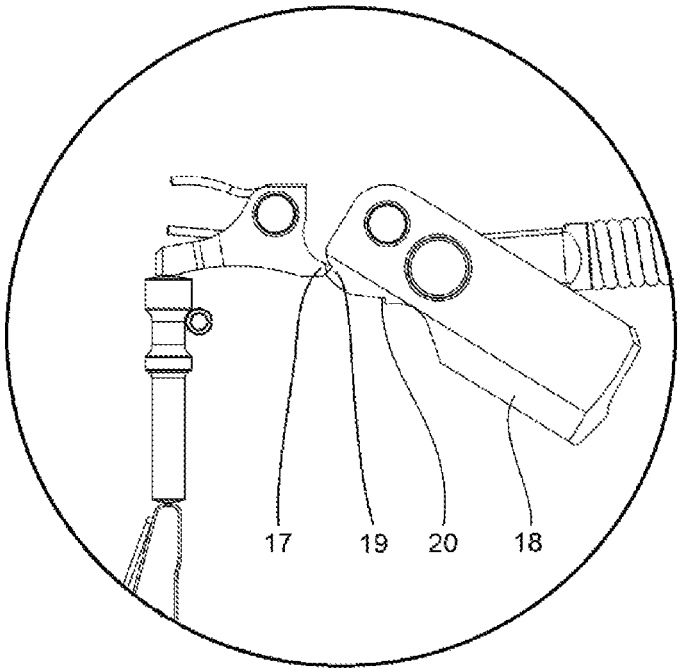
Figure 9:
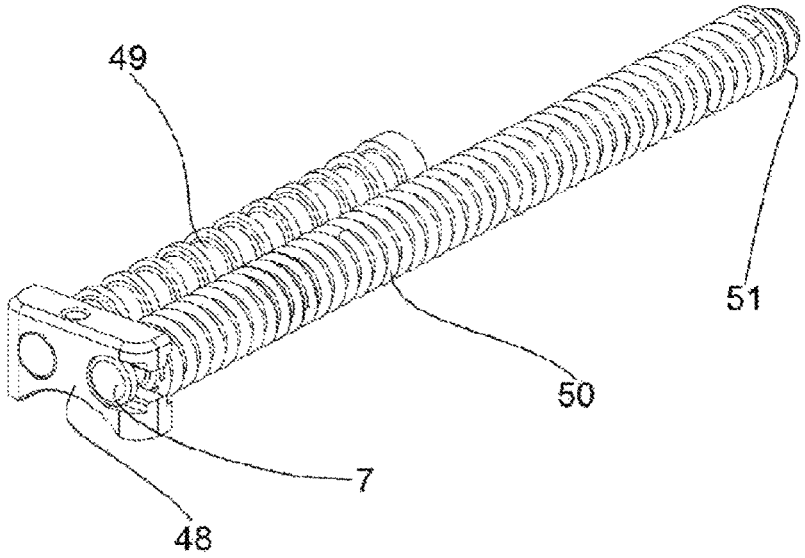
Figure 10:
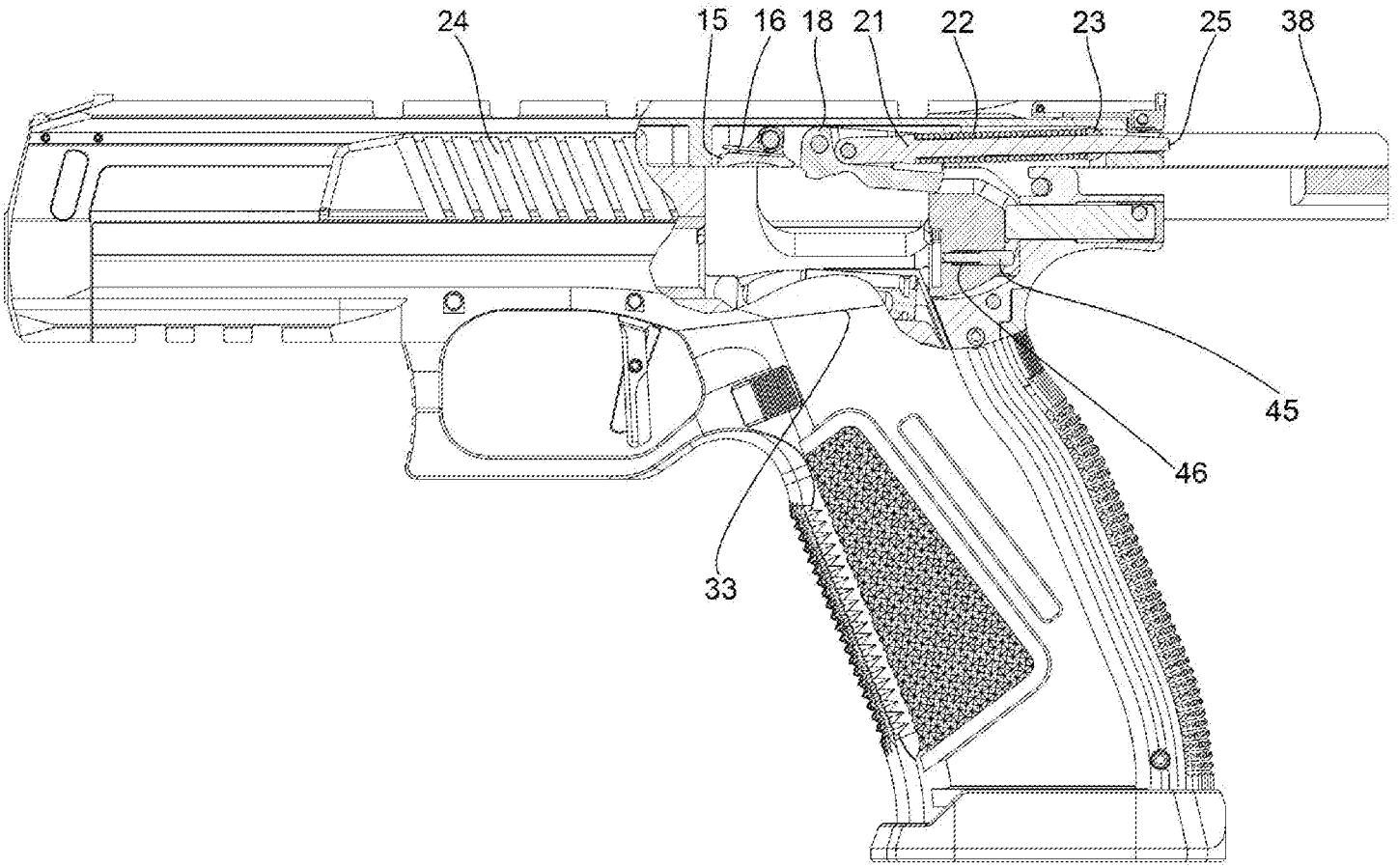
Figure 11:
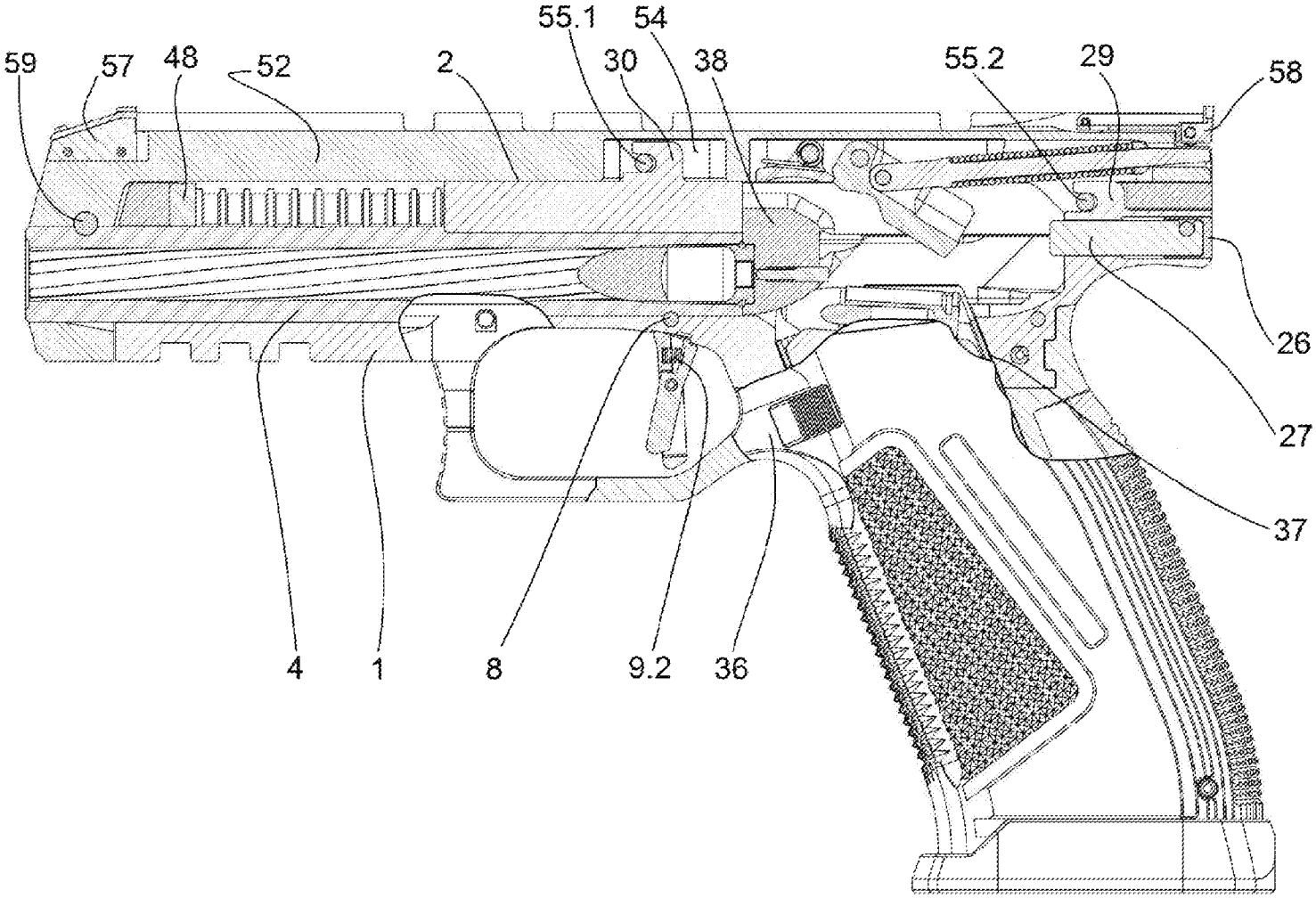
Figure 12:
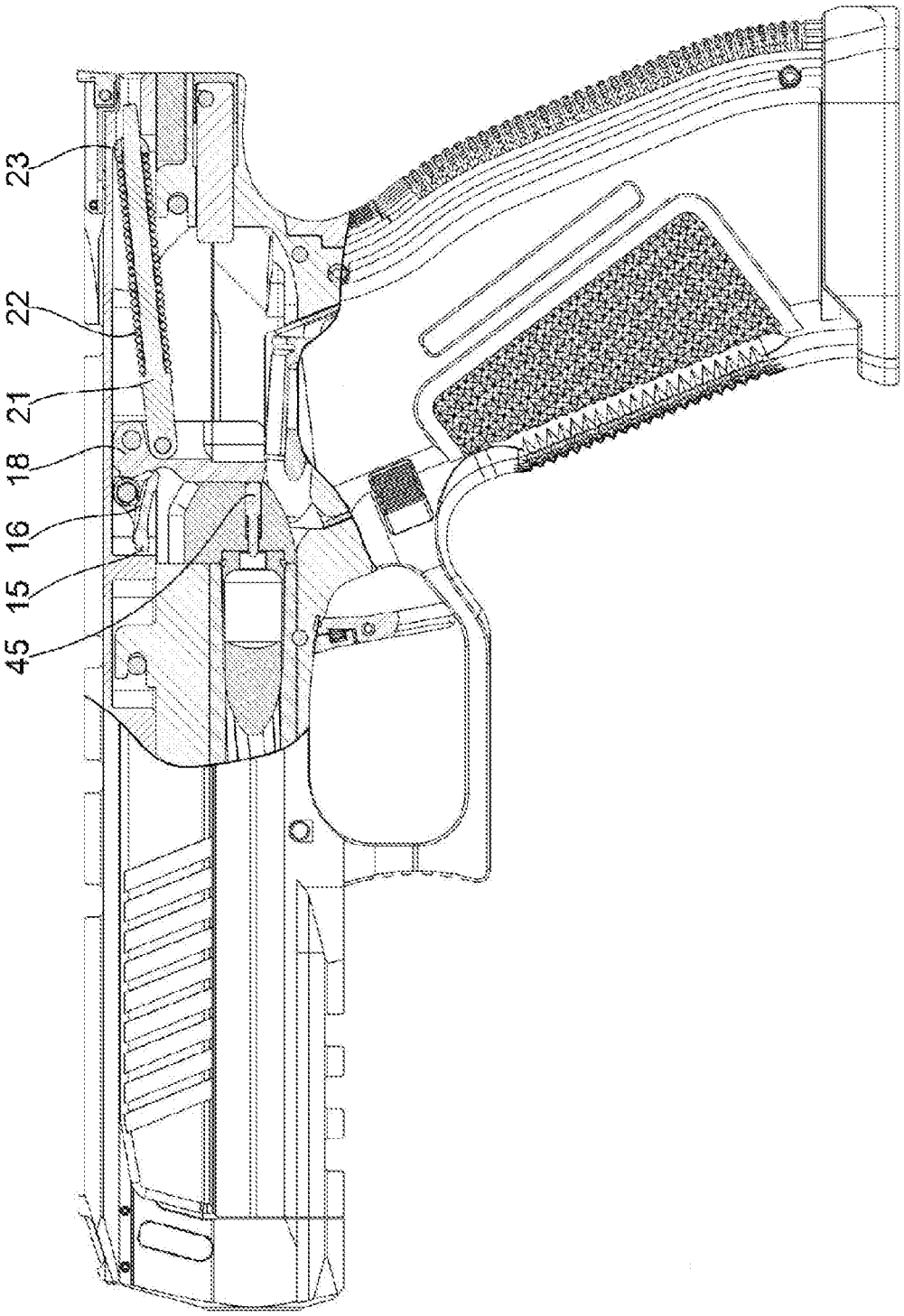
Figure 13:
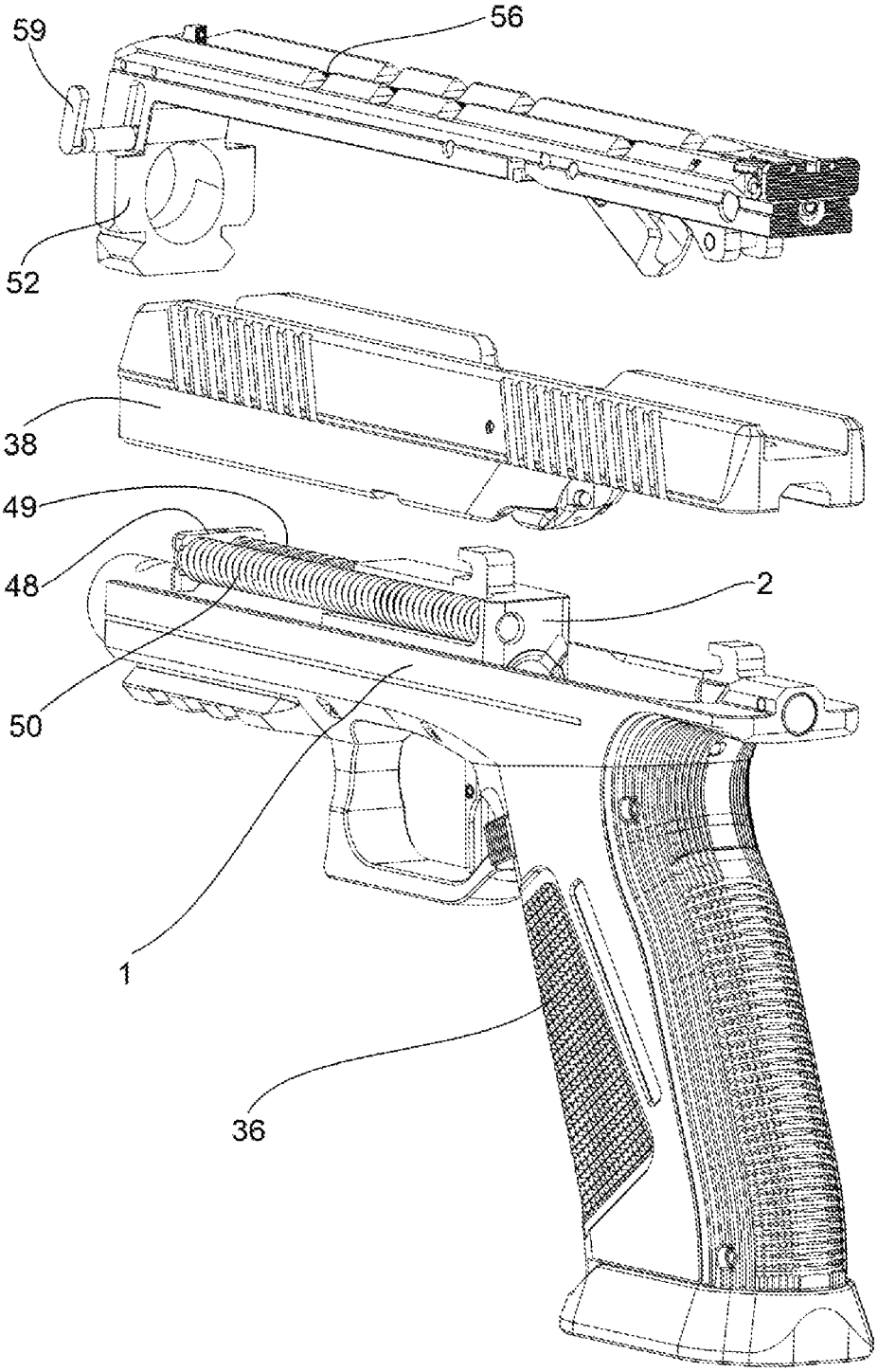

FIG. 1 provides a perspective top view of the pistol frame with the barrel mounted, FIG. 2 provides a perspective bottom view of the frame, FIG. 3 provides a perspective top view of the pistol slide, FIG. 4 provides a bottom view of the slide with the inner components exposed, FIG. 5 shows a detail of the slide from FIG. 4, FIG. 6 provides a perspective bottom view of the upper body, FIG. 7 shows the overall layout of the trigger mechanism and the hammer system, FIG. 8 shows a detail of the hammer from FIG. 7, FIG. 9 shows the assembly of the piston, clip, guide stud and recoil spring, FIG. 10 shows the pistol with the slide in the rear position (cocking the hammer), FIG. 11 shows the pistol ready for shooting, FIG. 12 provides a view of the pistol at the moment of a shot (the hammer hitting the firing pin and the firing pin hitting the cartridge cap), FIG. 13 provides a perspective view of the pistol with separated main parts.

EXAMPLE OF IMPLEMENTING THE INVENTION

The main load-carrying element of the pistol with a low-lying barrel is a frame 1 opened from above. The rear part of the frame 1 is concave and partially passable along the whole height. From above for the purposes of the placement and movement of the slide 38 and from below for interoperation with the magazine in the pistol grip 36. A base 2 is attached in the middle part of the frame 1, part of the base 2 being embedded in the frame 1. One large ongoing longitudinal circular barrel gap 3 is created in the base 2. The axis of the barrel gap 3 is parallel to the upper edges 70 of the frame 1 and is situated 4 mm below the level of the edge of the shooter's hand.

A non-moving forged thick-walled barrel 4 is inserted into the barrel gap 3. The barrel 4 has a shallow undercut 60 with a safety function at the top at the muzzle.

A circular smaller ongoing gap 5, to a large extent open, is created on the left in the shooting direction above the barrel gap 3. It has a reduced diameter at the end. A non-ongoing circular gas piston cavity 6 is created on the right, in the shooting direction. The axes of the barrel gap 3, smaller ongoing gap 5 and gas piston cavity 6 are mutually parallel. The connecting lines of the intersection points of their axes with the plane perpendicular to them, namely of the intersection point of the smaller ongoing gap 5 axis with the intersection point of the barrel gap 3 axis and of the intersection point of the gas piston cavity 6 axis with the intersection point of the barrel gap 3 axis represent clock hands showing approximately ten and two o'clock. [0028] The gas piston cavity 6 is connected via a non-rendered gas channel with the barrel 4. The lower part of the barrel 4 is attached to the frame 1 with two transverse fixing pins.

The trigger 9 is swivel suspended on the rear fixing pin 8 with its two upward rising shoulders 10. The safety 9.1 of the trigger is swivel anchored between them and is held in the secure position by the safety spring 9.2. The trigger 9 has the shape of a wide "Y", which gives it stability and prevents jamming. The shoulders 10 of the trigger are guided backwards behind the suspension point. The trigger spring 11 presses against the end of the trigger shoulder 10.

The disconnector 12 is swivel connected with one trigger shoulder 10. The disconnector 12 can only move upwards with a slight tilt against the pressure of the spring of the disconnector 13.

A rod 14, placed in the slide 38 and secured against falling out there, is freely lowered onto the disconnector 12.

A swivel attached hammer catch 15 is seated from above onto the rod 14, fabricated as a thin roller, and is pressed against the rod 14 by the spring 16 of the hammer catch. The hammer catch 15 is finished with a nick 17 of the hammer catch at the opposite end. The hammer 18 with its central nick 19 and further shifted safety nick 20 stands against the nick 17 of the hammer catch.

The prism-shaped hammer 18 with an inner undercut is swivel anchored in the upper end part into the upper body 52. The central nick 19 and the safety nick 20 are placed close to the anchoring point of the hammer 18.

A hammer stud 21 is swivel connected with the hammer 18 approximately at one third of its length counted from above and is finished in its undercut. A hammer spring 22 is pulled onto the hammer stud 21 and at the opposite end, the hammer spring 22 is propped against a roller 23, swivel attached to the upper body 52. At its free end, the hammer stud 21 is led through an opening in the roller 23. It is finished with a planar facet painted red like the indicator 25.

In the rear part of the frame 1 there is a magazine hole 37, which is a conspicuous cavity along the whole height of the frame 1. Behind it, a buffer tube 26 is mounted, in which the buffer 27 is located. It is made of a flexible material in order to absorb the residual energy of the slide 38 after a shot is fired.

The end of the rod-shaped ejector 28 and the rear hook 29, fabricated in the shape of a hook, oriented towards the barrel 4, which visually dominates the whole rear section of the frame 1, are also attached in the frame 1. With the mid hook 30, also in the shape of a hook, oriented towards the barrel 4 muzzle, mounted on the base 2, it constitutes elements for fixing the upper body 52.

A bottom body 31 with three traverse nicks 32 for anchoring additional accessories, is attached on the lower side of the frame 1.

A touch surface 33 is created in the lower part of the frame 1, around the magazine hole 37. A raised first auxiliary base 34 is created at its front edge. A second auxiliary base 35, also raised, is created at the rear edge of the touch surface 33.

Both the auxiliary bases 34, 35 are bilaterally longitudinally slotted, in parallel to the upper edges 70 of the frame 1. The touch surface 33 is inclined with respect to the upper edges 70 of the frame 1 in an angle of 10° for the purposes of the resolution of impact forces created while shooting.

A respectively customized pistol grip 36 is slid into both the auxiliary bases 34, 35 as far as it goes along the touch surface 33 and is secured against spontaneous movement in the end position. A non-rendered cartridge magazine is located in the pistol grip 36.

A prism-shaped slide 38 is inserted into the frame 1 from above, half of its mass being embedded in the frame 1. The upper, handling part projects over the frame 1 along the whole height. Slots 24 are created on part the outer sides for reliable grip.

A closed circular launch pad 39 is created in the slide 38 towards the end of the second third of the slide 38 body, when the beginning of the length is at the barrel 4 muzzle. An extractor 40 is obliquely placed in this part of the slide 38 to the right of the perpendicular central plane (in an angle containing 50° with it). It is a one-armed lever, finished with a catching tooth, swiveling around the pin 41 of the extractor against the pressure of the extractor spring 42.

An ongoing gap 43 for the penetration of the ejector 28 is created in the launch pad 39 near the center. The gap is cone-shaped from the rear side of the slide 38.

A firing pin hole 44 is created in the middle of the launch pad 39. The firing pin 45 is placed in it and is held in the basic position by the spring 46 of the firing pin. From the rear side of the slide 38, the firing pin 45 is secured against a non-permitted disengagement by a vertically placed pin of the firing pin 47.

A flat rectangular clip 48, whose lower side is shaped according to the outer diameter of the barrel 4, is inserted into the slide 38 in the front part. The rear end of a piston 49, whose cylindrical shape is interrupted by a series of evenly distributed incisions, is slid into the clip 48 on the right (in the shooting direction) and secured. The end of a guide stud 7, onto which a recoil spring 50 is slid, is embedded into the clip 48 on the left. The recoil spring 50 is laid out between the clip 48 at one end and the pad 51 of the spring at the other end.

The pad 51 of the spring is propped against a slightly enlarged diameter at the end of the guide stud 7. The length of the recoil spring 50 is close to the length of the barrel 4, which gives it good working and tension characteristics. Before the insertion of the slide 38 into the frame 1, the guide stud 7 with the recoil spring 50 is inserted into the smaller ongoing gap 5 with the pad 51 of the spring propped against the front of the gap with a smaller diameter.

The piston 49 is slid onto the beginning of the gas piston cavity 6.

On one of the outer sides of the slide 38 there is an undercut, which functions as an ejecting window 61 of empty cartridge cases.

Non-moving upper body 52 are slid onto the slide 38 with the front edge bent into a right angle, in which there is an exact gap of barrel 53 made tightly to the outer diameter of the barrel 4. An extensible safety pin 59 is also located there. On the lower side, in the middle section of the upper body 52 there is a cavity 54, in which a pin perpendicular to the orientation of the upper body 52 is transversely pressed onto the hook-shaped mid hook 30 as a mid counterpart 55.1. In the rear section of the upper body 52, in the lower part protruding from the outline, the rear counterpart 55.2 in the shape of a transverse pin, perpendicular to the orientation of the upper body, is pressed. It is a counterpart to the hook-shaped rear hook 29 in the frame 1. Said hammer catch 15, as well as the hammer 18 and roller 23 are attached to upper body 52 on the lower side.

The upper side of the upper body 52 is adapted for a possible installation of optoelectronics accessories. A canal 56 in the shape of a wide "U" is created across the middle of the upper side along the whole length. The front sights 57 are attached to the canal 56 in the front. Vertically and laterally micrometrically adjustable rear sights 58 are attached to the canal 56 in the back.

The clip 48, equipped with the above-mentioned elements and subsequently the slide 38 with components mounted are inserted into the frame from above 1 with a slid and secured pistol grip 36.

The pistol is completed and joined together by mounting the upper body 52 with the exact gap of barrel 53 being slid onto the barrel 4 muzzle, the mid counterpart 55.1 and rear counterpart 55.2, fabricated as a pin, being stuck into the hook of the mid hook 30 and rear hook 29.

The upper body 52 are secured by inserting the safety pin 59 into the undercut 60 at the barrel 4 muzzle.

By gripping the outer part of the slide 38 with fingers and pulling it backwards as far as it will go, the hammer 18 rises until its central nick 19 is caught with the nick 17 of the hammer catch. This prevents a spontaneous return of the hammer 18 into the initial position.

The hammer 18 is now in the functional position 70° from the impact surface on the firing pin 45. At the same time, the hammer spring 22 is pressed. The hammer stud 21 is extended backwards and the indicator 25 at its end indicates the weapon is cocked and ready to fire.

The return of the slide 38 is caused by the pressure of the recoil spring 50.

While moving forward, the slide 38 body catches the cartridge ejected from the magazine in the pistol grip 36 and inserts it into the barrel 4. There it pushes it all the way to the launch pad 39. At the same time, the extractor 40 catches the cartridge case by the rim.

In the end position of the slide 38, the rod 14 gets between the disconnector 12 and the hammer catch 15. The weapon is ready to fire.

The shot is prevented by the safety 9.1 of the trigger, which does not allow the initiation of the trigger 9 until it is pushed itself by the shooter's finger.

Another inhibition of the shot is the safety nick 20. It is used to catch the hammer 18 10° from the end of the firing pin 45 if without a prior complete pull of the trigger 9 a momentary release of the hammer catch 15 and a release of the hammer 18 occurred for any reasons, especially due to a fall of the pistol on a hard surface.

By pressing the safety 9.1 and subsequently with the same movement of the shooter's finger and the trigger 9 the disconnector 12 is lifted pressing the rod 14 onto the hammer catch 15.

Raising the hammer catch 15 pulls the nick 17 of the hammer catch out of the central nick 19. The hammer spring 22 ejects the released hammer 18 into the hit onto the firing pin 45. The other end of it hits the cartridge cap. That causes the weapon to fire.

The reactive recoil from the shot ejects the slide 38 backwards. During this movement, the extractor 40 pulls the cartridge case from the barrel 4 and the ejector 28, which gets to the cartridge case through the ongoing gap 43 in the launch pad 39, throws it out of the pistol through the ejecting window 61.

During the shot, gases from the powder charge get from the barrel 4 through the gas channel into the gas piston cavity 6, where they constitute resistance in the way of the penetrating piston 49. That acts as a hydraulic brake of the slide 38.

During its backward movement, the slide 38 prepares the hammer 18 for the next shot. It leans against the buffer 27 and then is returned back by the recoil spring 50.

On its way back, it pulls another cartridge into the barrel.

The moving slide 38 carries with it also the rod 14, so a new shot cannot occur before the full insertion of a new cartridge into the barrel 4. Thus, the rod 14 also fulfills the function of an automatic safety causing a complete closure of the barrel 4 (cartridge chamber).

Moreover, also the trigger 9 has to return to the starting position, so that the disconnector 12 can get under the rod 14. Otherwise during the return of the slide 38 the rod 14 would deflect the disconnector 12 from the alignment from the side, thus rendering the trigger mechanism non-functional.

That actually means that the pistol can only fire single shots, not bursts.

List of Reference Signs

| | |
|---|---|
| 1 frame | 31 bottom body |
| 2 base | 32 traverse nick |
| 3 barrel gap | 33 touch surface |
| 4 barrel | 34 first auxiliary base |

-continued

List of Reference Signs

| | |
|---|---|
| 5 smaller ongoing gap | 35 second auxiliary base |
| 6 gas piston cavity | 36 pistol grip |
| 7 guide stud | 37 magazine hole (shaft) |
| 8 rear fixing pin | 38 slide |
| 9 trigger | 39 launch pad |
| 9.1 safety of trigger | 40 extractor |
| 9.2 safety spring | 41 pin of extractor |
| 10 shoulder | 42 extractor spring |
| 11 trigger spring | 43 ongoing gap |
| 12 disconnector | 44 firing pin hole |
| 13 spring of disconnector | 45 firing pin |
| 14 rob | 46 spring of firing pin |
| 15 hammer catch | 47 pin of firing pin |
| 16 spring of hammer catch | 48 clip |
| 17 nick of hammer catch | 49 piston |
| 18 hammer | 50 recoil spring |
| 19 central nick | 51 pad of spring |
| 20 safety nick | 52 upper body |
| 21 hammer stud | 53 exact gap of barrel |
| 22 hammer spring | 54 cavity |
| 23 roller | 55.1 mid counterpart |
| 24 slot | 55.2 rear counterpart |
| 25 indicator | 56 canal (slot) |
| 26 buffer tube | 57 front sights |
| 27 buffer | 58 rear sights |
| 28 ejector | 59 safety pin |
| 29 rear hook | 60 undercut |
| 30 mid hook | 61 ejecting window |

The invention claimed is:

1. A pistol with a low-lying barrel, comprising:

a load-carrying element being a fixed frame, the fixed frame comprising:

two longitudinal upper edges on an upper side of the fixed frame;

an opening on the upper side of the fixed frame and defined by the two longitudinal upper edges;

a concave portion formed on a rear side of the fixed frame;

a magazine hole formed on the lower side of the fixed frame;

a touch surface formed around the magazine hole and inclined with respect to the two longitudinal upper edges of the fixed frame;

a bottom body formed on a lower front side of the fixed frame;

a base provided in a middle of the fixed frame, the base projecting over the two longitudinal upper edges of the fixed frame through the opening defined by the two longitudinal upper edges of the fixed frame, the base comprising:

a mid hook attached to the base;

a gap for a guide stud;

a gas piston cavity; and a barrel gap formed under the gas piston cavity; and a buffer tube formed at a rear part of the fixed frame and including:

a rear hook formed on top of the buffer tube and protruding above the two longitudinal upper edges of the fixed frame; and an ejector oriented towards the base and attached to the buffer tube;

a non-moving barrel attached to the base and having a barrel muzzle and a rear part inserted in the barrel gap and internally interconnected with the gas piston cavity;

a trigger mechanism comprising a trigger movably connected to the fixed frame, a trigger safety, and a shoulder movably connected to a swiveling disconnector;

a pistol grip with a cartridge magazine, the pistol grip being propped and secured against the touch surface of the fixed frame;

a moving slide inserted in the opening on the upper side the fixed frame and partially embedded in the fixed frame, the moving slide having an upper opening and a bottom opening and being equipped with a launch pad, an extractor, a light firing pin, a clip, a piston, the guide stud with a recoil spring and a rod connected to the trigger mechanism; and a fixed upper body covering the moving slide from above, and having:

a bent front section formed with an exact gap for the non-moving barrel for sliding the fixed upper body onto the barrel muzzle through said exact gap;

a cavity with a mid counterpart formed on a lower side and in a middle section of the fixed upper body, wherein the mid counterpart is attached to the mid hook of the base such that the fixed upper body is connected to the fixed frame;

a rear counterpart provided at a rear part of the fixed upper body and detachably connected to the rear hook;

a hammer system of the pistol mounted on an inner side of the fixed upper body, the hammer system comprising:

a hammer catch with a hammer catch spring;

a hammer connected to the hammer catch; and a hammer stud connected to the hammer, with a hammer spring and a roller;

front sights mounted in a front of the fixed upper body; and adjustable rear sights provided in a back of the fixed upper body, and mounted on an outer, upper surface of the fixed upper body, wherein a guideway of the moving slide is delimited by inner surfaces of the fixed upper body and the fixed frame.

2. The pistol with a low-lying barrel according to the claim 1, wherein the launch pad is closed, and the moving slide further has an ongoing gap for the ejector next to a middle firing pin hole for the firing pin, wherein the ongoing gap has a conical mouth from a rear side of the launch pad, and an extractor is obliquely placed on the moving slide, swiveling sideways against a pressure of an extractor spring by an inserted cartridge ends next to the launch pad, wherein the guide stud and the piston are connected via a clip in a front part of the moving slide, and wherein the rod has a delimited movement only in one line and is secured against falling out, the rod being a separated connecting element of the trigger via the disconnector, and the rod and the disconnector are installed in the fixed frame with the hammer system through the hammer catch.

3. The pistol with a low-lying barrel according to claim 2, wherein the trigger is Y-shaped, having a pair of shoulders, and the trigger safety swivelingly anchored between the pair of shoulders, the pair of shoulders being bent backwards, and an end of at least one of the pair of shoulders being pressed by a trigger spring, and wherein the disconnector is connected at the end of the at least one of the pair of shoulders and held down by a disconnector spring from one side.

4. The pistol with a low-lying barrel according to claim 2, wherein the hammer stud is movably attached to the hammer at one end thereof, is led through an opening in the roller and is finished with an indicator, and wherein the hammer spring is slid onto the hammer stud between the one end of the hammer stud and the roller.

5. The pistol with a low-lying barrel according to claim 1, wherein the trigger is Y-shaped, having a pair of shoulders and the trigger safety swivelingly anchored between the pair of shoulders, the pair of shoulders being bent backwards, and an end of at least one of the pair of shoulders being pressed by a trigger spring, and wherein the disconnector is connected at the end of the at least one of the pair of shoulders and held down by a disconnector spring from one side.

6. The pistol with a low-lying barrel according to claim 5, wherein the hammer stud is movably attached to the hammer at one end thereof, is led through an opening in the roller and is finished with an indicator, and wherein the hammer spring is slid onto the hammer stud between the one end of the hammer stud and the roller.

7. The pistol with a low-lying barrel according to claim 1, wherein the hammer stud is movably attached to the hammer at one end thereof, is led through an opening in the roller and is finished with an indicator, and wherein the hammer spring is slid onto the hammer stud between the one end of the hammer stud and the roller.

* * * * *